United States Patent [19]

Wasilewski

[11] Patent Number: 4,911,485

[45] Date of Patent: Mar. 27, 1990

[54] LATCH STRUCTURE

[75] Inventor: Michael D. Wasilewski, La Habra, Calif.

[73] Assignee: The Hartwell Corporation, Placentia, Calif.

[21] Appl. No.: 303,842

[22] Filed: Jan. 30, 1989

[51] Int. Cl.[4] ..... E05C 1/06

[52] U.S. Cl. ..... 292/139; 292/DIG. 31; 292/DIG. 49; 292/DIG. 61

[58] Field of Search ..... 292/139, 167, D31, D49, 292/D61

[56] References Cited

U.S. PATENT DOCUMENTS

| | | | |
|---|---|---|---|
| 2,695,803 | 11/1954 | Summers | 292/DIG. 31 |
| 2,721,750 | 10/1955 | Rudis et al. | 292/139 |
| 2,752,186 | 6/1956 | Morrison | 292/139 |
| 2,944,848 | 7/1960 | Mandolf | 292/DIG. 31 |
| 4,099,751 | 7/1978 | Poe et al. | 292/139 |
| 4,828,299 | 5/1989 | Poe | 292/DIG. 31 |

*Primary Examiner*—Richard E. Moore
*Assistant Examiner*—Michael Milano
*Attorney, Agent, or Firm*—Lyon & Lyon

[57] ABSTRACT

A latching structure defined by a mount, a handle pivotally mounted to the mount and linked with a latch pin slidably mounted in the mount. The linkage between the handle and the latch pin includes first parallel links pivotally mounted to the handle and pivotally mounted to the latch pin. Second links are pivotally mounted to the first links and to a spring block slidably mounted on the latch pin. A spring is placed in compression between a shoulder on the latch pin and the spring blocks. Consequently, the linkage mechanism operates to actuate the latch pin with the handle and create an overcenter mechanism to bias the entire mechanism to either a fully opened position or a fully closed position. A gasket is provided on a flange associated with the handle to seal the latch mechanism when the mechanism is strongly biased by the spring into the closed position.

4 Claims, 2 Drawing Sheets

LATCH STRUCTURE

BACKGROUND OF THE INVENTION

The field of the present invention is flush pin latches. Latches, particularly flush latches which control movement of latch pins for engaging or disengaging latch sockets are commonly used in aircraft. The situations and conditions under which these latches are used can be characterized as stressed; extremes of temperature, air pressure, air velocity, and the presence of moisture and dust are expected.

Flush latches employed for aircraft have typically incorporated a handle with a trigger assembly or locking mechanism to specifically lock the handle to the mounting structure. To operate the device, the trigger is actuated to release the handle from a locked position on the mounting structure. The handle may then be actuated to actuate the latch. Separate overcenter mechanisms have also been devised and incorporated with such latching structures to help bias the latch mechanism to either a fully opened or fully closed position. One such example of a latch structure as discussed above is found in U.S. Pat. No. 4,099,751 to Poe et al., the disclosure of which is incorporated herein by reference.

SUMMARY OF THE INVENTION

The present invention is directed to an improved latching structure having an elongate latch member which slides longitudinally to engage a locking socket. A biasing mechanism, conveniently a spring, is associated with an overcenter mechanism forming part of the linkage between an actuating handle and the latch member. The overcenter mechanism operates to maintain the latch in a fully closed position such that a seal may be advantageously accomplished between the handle and the mounting for the latch. A trigger mechanism becomes unnecessary with the present invention.

To accomplish the foregoing, one aspect of the present invention provides for a longitudinally extending latch member linked to a handle by an overcenter mechanism including first and second link members. The first link extends between the handle and the latch member for positive actuation and placement of the latch member in either the open or closed position. The second link provides an overcenter mechanism in association with a spring to firmly retain the latch in the closed position.

Accordingly, it is an object of the present invention to provide an improved latching mechanism. Other and further objects and advantages will appear hereinafter.

DETAILED DESCRIPTION OF THE PREFERRED EMBODIMENT

Figure 1:
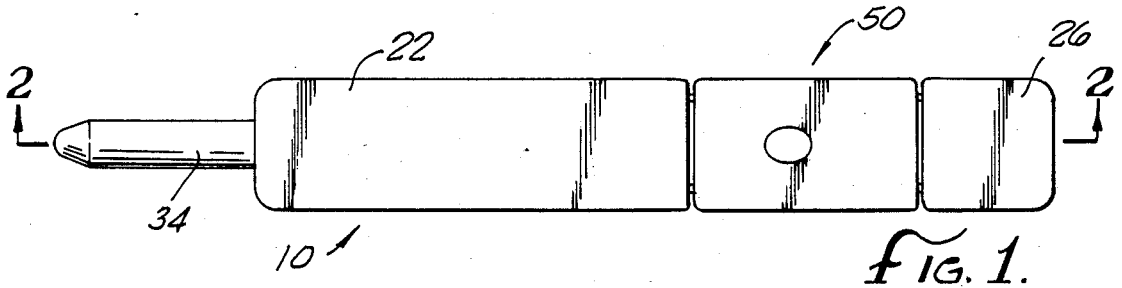
FIG. 1 is a plan view of an embodiment of the present invention.

Turning in detail to the drawings, a latch structure is illustrated. In this preferred embodiment, the latch structure is intended to use with aircraft panels and the like with the outer surface of the latch structure flush with the surrounding surface of the aircraft when the latch structure is in the closed position.

The latch structure includes a mount, generally designated 10. The mount includes a central body structure 12 and two side plates 14 and 16. The side plates are fastened by rivets or other devices 18 to either side of the central body structure 12. The central body structure 12 includes a guideway 20 and an upper flush surface 22. A flange 24 extends around the upper flush surface 22 to come into abutment with the surrounding aircraft surface. A second central body structure 26 is similarly constructed to the central body structure 12 with the side plates 14 and 16 extending to either side thereof. A fastener 28 retains the components together.

Two mounting holes 30 and 32 extend transversely through the mount 10 for mounting the entire latch structure in place.

Slidably mounted within the guideway 20 is an elongate latch member 34. The elongate latch member 34 is shown here to be cylindrical in cross section with a blunted end. A portion 36 of the latch member 34 is shown to have a reduced cross section. A slot 38 extends through the central body structure 12 in alignment with the guideway 20. The slot 38 has parallel planar upper and lower surfaces. The latch member 34 has guides 40 and 42. The guide 40 is rectangular in cross section with a cylindrical hole therethrough. The cylindrical hole receives the latch member 34 while the rectangular outer shape slides within the slot 38. A pin 44 retains the guide 40 in place about the latch member 34. The guide 42 is similarly structured with a rectangular cross section and a circular central bore to receive the reduced diameter section 36 of the latch member 34. In the case of the guide 42, it is slidably mounted on the latch member 34 unlike the guide 40. Located between the guides 40 and 42 is a spring 46. The spring 46 is maintained in compression with the shoulder of the latch member 34 and guide 40 acting as a stop and the guide 42 acting as a spring block.

Figure 2:
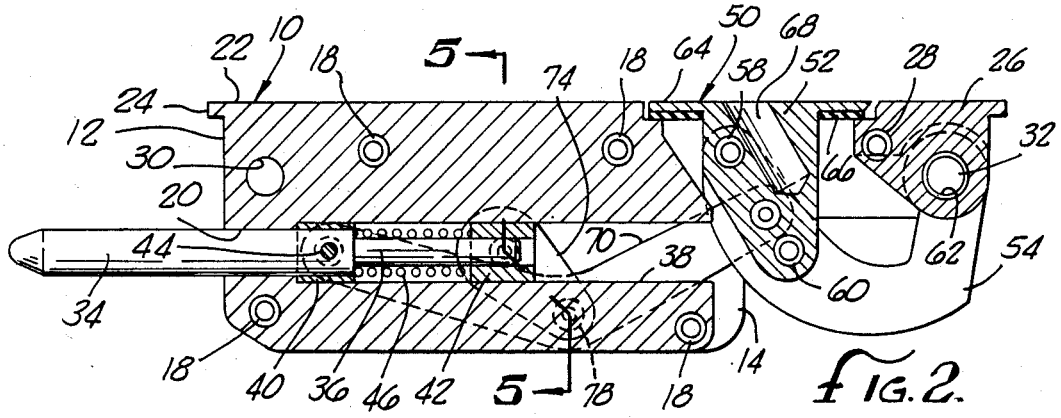
FIG. 2 is a cross sectional side view taken along line 2—2 of FIG. 1.
Figure 3:
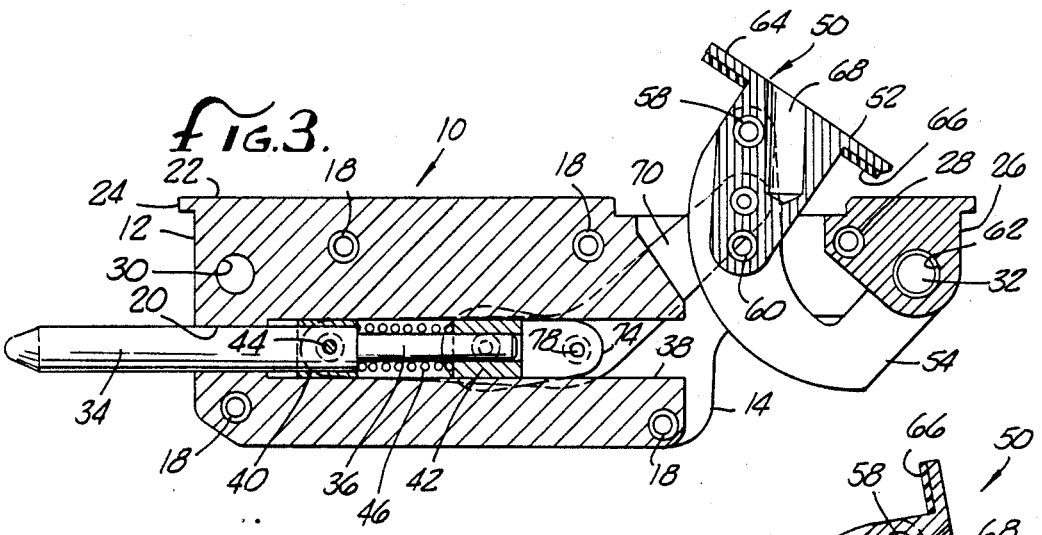
FIG. 3 is a cross sectional side view taken along line 2—2 of FIG. 1 illustrating the latch in a partially opened position.
Figure 4:
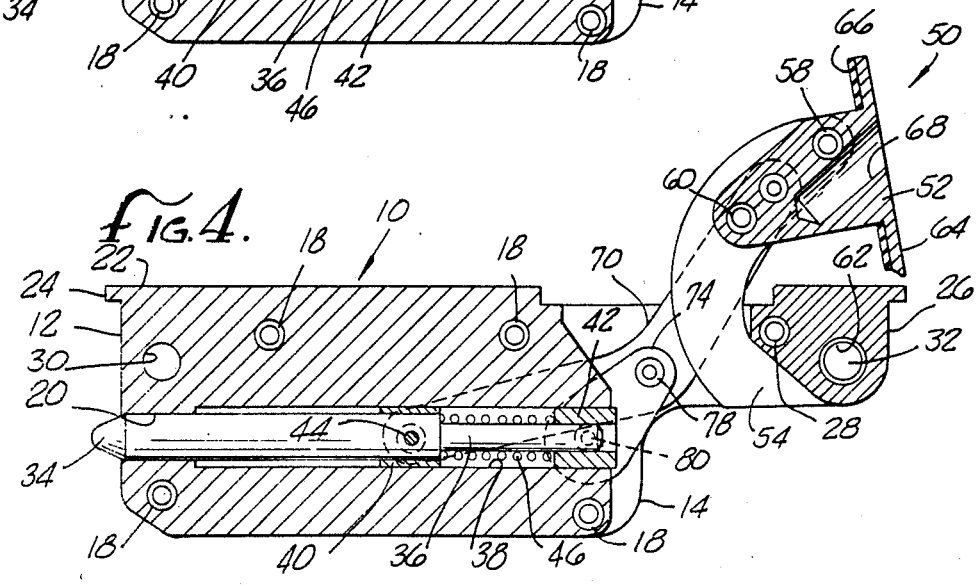
FIG. 4 is a cross sectional side view taken along line 2—2 of FIG. 1 illustrating the latch in a fully opened position.
Figure 6:
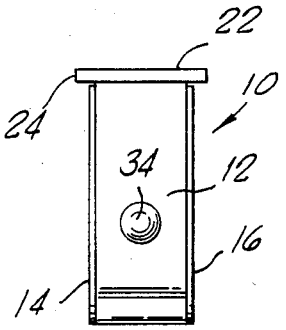
FIG. 6 is an end view illustrating the pin end of the latch.
Figure 5:
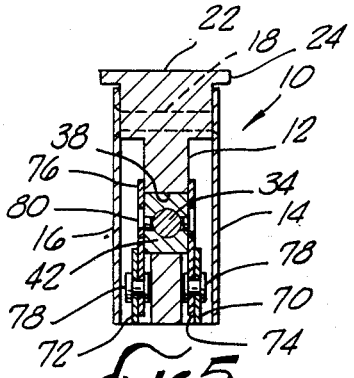
FIG. 5 is a cross sectional end view taken along line 5—5 of FIG. 2.
Figure 7:
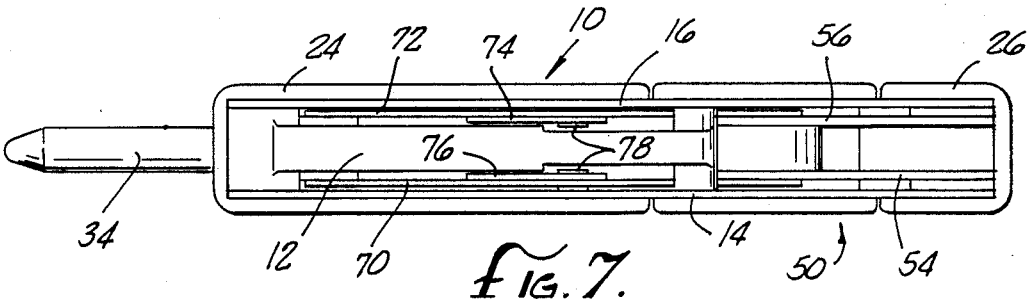
FIG. 7 is a bottom view of the preferred embodiment.

A handle, generally designated 50, is defined as a composite structure consisting of a handle block 52 and pivot members 54 and 56. The handle block 52 is located between the two pivot members 54 and 56 and assembled therewith by means of fasteners or rivets 58 and 60. The other end of the pivot members 54 and 56 are pinned about a hollow pin 62 lining the mounting hole 32. As can be seen from FIGS. 2, 3 and 4, the handle pivots from a first, open positions as seen in FIG. 4 to a second, closed position as seen in FIG. 2. A recess is provided in the mount 10 to receive the flange 64 of the handle block 52. A rubber gasket 66 is positioned beneath the flange 64 to contact the mount 10 and seal the opening provided for the handle 50. A bore 68 is presented in the middle of the handle block 52 on the upper surface thereof to allow for placement of a screwdriver or other rigid tool in the handle for pivotally opening the handle assembly and in turn the entire latch mechanism.

Located outwardly of the pivot members 54 and 56 and pivotally mounted to the handle assembly 50 are two parallel bent links 70 and 72. The links 70 and 72 are pivotally mounted at the other end of each to the other side of the guide 40. They are pivotally mounted about the pin 44. Thus, as can be seen in FIGS. 2, 3 and 4, as the handle 50 progresses from the closed position to the open position, the bent links 70 and 72 draw the latch member 34 from a fully extended position to a fully retracted position.

Positioned inwardly of the bent links 70 and 72 are two overcenter links 74 and 76. The overcenter links are pivotally pinned to the bent links 70 and 72 by means of axially aligned pins 78. The other end of each of the overcenter links 74 and 76 is pinned to the outer side of the guide 42 by pins 80. These pins allow pivotal movement between the links 74 and 76 and the guide 42. The overcenter links 74 and 76, being pivotally pinned to the bent links 70 and 72, move across the longitudinal line of the latch member 34. In doing so, they advance and then retract the guide 42 toward and away from the spring 46. Thus, the spring 46 is further compressed by this action. Accordingly, an overcenter linkage mechanism is created by this arrangement. This makes the fully open and fully closed positions of the handle 50 the positions of greatest stability. In the closed position, the handle is forced downwardly to compress the gasket 66 against the mount 10. This creates an appropriate seal for uses contemplated by the latch.

In operation, the latch is shown in its closed position in FIG. 2. In this position, the elongate latch member 34 is fully extended to engage the receiving latch bore. The seal 66 is compressed by the linked operation of the spring 46. A tool may be inserted into the bore 68 and the latch handle is opened by pivoting the tool away from the direction of the latch pin 34. This motion forces the handle to pivot upwardly and the overcenter links 74 and 76 to pivot toward the centerline of the elongate latch member 34. This in turn further compresses the spring 46 which resists such opening movement. Once the overcenter links 74 and 76 reach the position as illustrated in FIG. 3, they are at an unstable neutral position. Once overcenter, the latch progresses to a fully open position under the influence of the spring 46. This position is illustrated in FIG. 4. The reverse operation closes the mechanism.

Accordingly, an improved latch structure is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A latching structure comprising a mount including a guideway;

an elongate latch member slidably mounted in said guideway;

a handle pivotally mounted to said mount to have a first, open position and a second, closed position;

a first link pivotally mounted to said handle at a first end and pivotally mounted to said latch member at a second end;

a spring positioned on said latch member;

a spring block slidably mounted on said latch member at a first end of said spring;

a stop fixed to said latch member at a second end of said spring; and a second link pivotally mounted at a first end to said first link between said handle and said latch member and to said spring block at a second end, said spring being under compression between said spring block and said stop, said second link being pivotally mounted to said first link such that said second link crosses the longitudinal line of said latch member between said open and closed positions of said handle.

2. The latching structure of claim 1 wherein said handle includes a flange, said mount includes a hole into which said handle is positioned, said flange engaging the perimeter of said hole.

3. The latching structure of claim 2 further comprising a resilient gasket positioned on said flange to mate with and seal said flange to said hole.

4. The latching structure of claim 1 further comprising two said first links and two said second links, said first links being pivotally mounted to the opposite sides of said handle, each said second link being pivotally mounted to a said first link, said second links also be pivotally mounted on opposite sides of said spring block.

* * * * *